United States Patent [19]

Schuck et al.

[11] Patent Number: 4,505,210

[45] Date of Patent: Mar. 19, 1985

[54] MULTIPLE HEARTH FURNACE CHAMBER

[75] Inventors: Jack K. Schuck, Wausau; Neal J. Adams, Weston, both of Wis.

[73] Assignee: Zimpro Inc., Rothschild, Wis.

[21] Appl. No.: 599,846

[22] Filed: Apr. 13, 1984

[51] Int. Cl.[3] ..... F23M 5/00

[52] U.S. Cl. ..... 110/336; 110/225; 432/247; 432/251

[58] Field of Search ..... 110/225, 336, 337; 432/247, 251, 252

[56] References Cited

U.S. PATENT DOCUMENTS 1,532,568 4/1925 Antisell ..... 432/252

2,283,641 5/1942 Martin et al. ..... 110/225

4,212,636 7/1980 Paviak ..... 110/225 X

*Primary Examiner*—Edward G. Favors

*Attorney, Agent, or Firm*—Allen H. Erickson; Thomas L. Johnson; B. Woodrow Wyatt

[57] ABSTRACT

A multiple hearth furnace chamber where each arched or conical hearth is independently supported by the outer metal shell. An expansion joint below each hearth allows for vertical movement of the interior refractory wall panels without significant vertical movement of the hearths. The expansion joint comprises an insulating refractory material which absorbs the expansion of the inner refractory (firebrick) wall panels without significant permanent deformation.

8 Claims, 7 Drawing Figures

MULTIPLE HEARTH FURNACE CHAMBER

BACKGROUND OF THE INVENTION

1. Field of Invention

This invention relates to the construction of the walls and hearths of a refractory-lined multiple hearth furnace. More particularly, the invention relates to a furnace having hearths, insulation and refractory brickwork apparatus so arranged as to avoid problems caused by expansion of the inner brickwork and differential expansion of the inner and outer walls of the furnace due to heating and cooling cycles in the furnace.

2. Information Disclosure Statement

Refractory lined multiple hearth furnaces used for incineration of municipal sewage sludge, refuse and industrial wastes, and regeneration of granular activated carbon, are well known. These furnaces commonly contain between four and twelve hearths. The typical wall and hearth construction of such a prior art furnace is as illustrated in FIG. 1. A vertically oriented cylindrical steel shell 1, comprises the exterior wall. The shell is lined with one or more layers of a low strength, high insulating capacity material 2. The interior wall is built of firebrick 3, to resist the high temperatures, and corrosive and abrasive conditions within the furnace.

Wherever a hearth is required, the steel wall is reinforced externally by a steel ring 4, known commonly as a "buckstay band". The commonly used method of making up the circumferential joint in the buckstay band is to set a splice plate across the joint and connect the plate to the band on either side of the joint with structural bolts. Against the interior of the steel wall is placed a ring of high strength castable refractory material 5. Against the castable refractory ring 5 and resting upon the firebrick wall 3, a ring 6 of specially shaped firebrick sections is placed. These sections are commonly called "skewback bricks". The hearths 7 are constructed of firebrick, in the general form of a circular, upwardly arched dome or conical frustum. In some cases, the roof 8 is also constructed as an upwardly arched dome or cone, in other cases it is a flat slab of castable refractory material, anchored to a flat steel top plate 9.

Because of the thickness of the wall section (commonly over 12 inches) and the insulating capacity of its inner layer 2, there will be a substantial temperature difference between the inner firebrick wall and the outer steel wall when the furnace is in operation. This temperature difference, plus the differences in expansion coefficients between the steel and the brick, results in an uneven expansion across the wall, with the brick side expanding much more than the steel side. The typical wall design includes only one expansion joint 10, between the top of the firebrick wall and the interior surface of the furnace roof 8. In recently built furnaces, it has been found that this design provision is inadequate to protect the furnace from damage due to differential expansion between the inside and outside portions of the wall. It is believed that this is due to the closer dimensional tolerances and flatter, smoother surfaces of modern firebrick as compared to the products of past years, which improvements are due to advancements in firing techniques and better quality control. An unforeseen result of using these bricks in the traditional design is that there are now far fewer "informal" sites where expansion can be taken up. Before, bricks often rested against each other on a few high spots, which spots quickly crumbled due to expansion pressure or wore off due to expansion-induced movement. Now, resting more solidly against each other, the effect of expansion of each brick is more nearly directly accumulative. Results of this inadequately controlled expansion can be serious.

The most obvious effect of inadequately controlled expansion are found on the hearths. One effect which has been observed is excessive rising of the hearths. Whenever the furnace is heated up, the bricks in the interior wall expand vertically. The furnace floor 11 attempts to restrain the bricks from moving downward. Since the skewback bricks are an integral part of the wall, the design assumes that they will also move upward, raising their hearths with them. It can be seen that each successive higher hearth will rise more than the next lower one. This amount of rise is added to the expected rise due to expansion of the hearth bricks themselves and is accounted for in the initial design by careful placement of doors and other interior projections above the expansion zone.

Problems arise, however, due to uncontrolled "locking in" of hearths. Referring to FIG. 2, it can be seen that because of its arched configuration and the special shape of the skewback, the hearth loads, live and dead, are transmitted into the skewback ring and transformed into a major horizontal thrust and a lesser downward vertical thrust. The vertical load is resisted by friction between the skewback 6 and the castable ring 5 and then by friction between the castable ring 5 and the steel wall 1. The horizontal load is resisted by ring tension in the buckstay band 4. It is not possible to accurately design the friction surfaces between 6 and 5 or 5 and 1. Therefore, it cannot be predicted with certainty that when the firebrick wall 3 expands due to heat, the skewback 6 will move upward relative to the castable 5, or the castable 5 will move upward relative to the steel wall.

If the skewback does not move upward during hot operation of the furnace, or if it wedges after rising and does not settle back when the furnace cools, the hearth is said to be "locked in". In some cases, "locked in" hearth will have a resistance which exceeds the compressive strength of the firebrick 3 comprising the interior wall. In this case the wall brick expansion forces will cause the bricks to crack or spall, causing permanent damage.

Another problem, caused by hearths "locked in" after rising, is that on cooling down, the brick below the locked hearth contracts and settles back down, leaving open gaps. Because of the turbulence and the heavy particulate loading of the furnace gases, small amounts of ash are blown into these gaps. On the next heatup, the full gap is no longer available to take up wall expansion, and more pressure is applied to the upper skewback. In some cases, the skewback resists, causing cracking and spalling due to overstress of the bricks. Other times, the skewback moves up to a new higher elevation, not contemplated in the original design and then locks at the new location. After a number of such cycles, the hearth rises far enough to interfere with other furnace internals, and the wall bricks above the rising hearth (or hearths) apply pressure to the internal wall projections such as burners and thermocouples, damaging them as well as the bricks.

Still another problem of prior art wall brick expansion is loosening and movement of the bricks in the hearth. FIG. 3 shows a situation where downward pressure due to a locked hearth above has caused the skewback brick 6 to pivot from its original position (as shown on FIG. 1) as a result of expansion of firebrick 3A and resistance of firebrick 3 comprising the interior wall. This causes some downward displacement of the hearth bricks 7a, 7b and 7c, which reduces the bearing surface between brick 7a and skewback 6, causing wear on the surfaces. It also produces localized overstress situations, causing cracking and spalling as shown in FIG. 3. After repeated heatup-cooldown cycles, the hearth bricks will slip down significantly, causing a measurable flattening of the arch, which reduces its structural stability. In some cases, because of the changed arch geometry, the hearth arch will no longer rise on heatup to compensate for hearth brick expansion. Instead, the hearth tends to grow larger in diameter. This overstresses the buckstay band and shell wall, causing them to stretch permanently. The hearth bricks will then drop still further on subsequent cooldown, and the wall and band stretching will increase on following heatups, until ultimately the hearth collapses.

The above are examples of the types of damage commonly observed in multiple hearth furnaces after several years of operation including 40 to 50 start-up-cooldown cycles. These are not the only modes or mechanisms for causing damage, but are selected because they can be more easily described than some of the others. Overall, uneven expansion across the multiple hearth furnace wall, as commonly designed during the past 60-plus years, is a serious contributor to shortened refractory life.

SUMMARY OF THE INVENTION

Despite the long history of multiple hearth furnaces, and long-standing knowledge of the problems described above, no satisfactory solution has been proposed or used prior to the instant invention.

This invention is a multiple hearth furnace chamber, comprising:

a cylindrical metal shell, having its axis oriented vertically, having one or more buckstay bands horizontally encircling its exterior to absorb outward-directed radial forces, and having refractory roof and floor;

a plurality of upwardly-directed, refractory, temperature-expansible hearths spaced vertically within said shell, having openings for passage of combustibles, gases and ash therethrough, each hearth having its outer perimeter in the same horizontal plane as one of said buckstay bands;

spaces within said chamber between said hearths comprising hearth spaces;

plural rings of high strength castable refractory, each encircling the inside of said shell in the same horizontal plane as one of said buckstay bands;

a single row of skewback bricks encircling said perimeter of each of said hearths and abutting said refractory rings of high strengh castable refractory, to direct forces generated by the weight and radial thermal expansion of said hearths through said refractory rings and said shells to said buckstay bands such that friction between said shell and said refractory rings and between said refractory rings and said skewback bricks support each hearth independently in a substantially unchanging horizontal plane;

furnace lining comprising panels of firebricks encircling and spaced from said inside of shell between adjacent hearths, resting on and supported by the skewback bricks immediately below each of said panels and separated from the skewback bricks immediately above each of said panels by an expansion joint;

said expansion joint comprising an insulating, compressible, refractory material to absorb vertical displacement of said panels of firebricks resulting from thermal expansion, without generating high stresses on skewback bricks above each of said panels; and thermal insulation filling space between said firebrick panel lining and said metal shell.

This invention significantly reduces the thermally-induced stresses on the firebricks, skewack bricks, and other parts of the furnace.

DESCRIPTION OF THE PREFERRED EMBODIMENT

Figure 4:
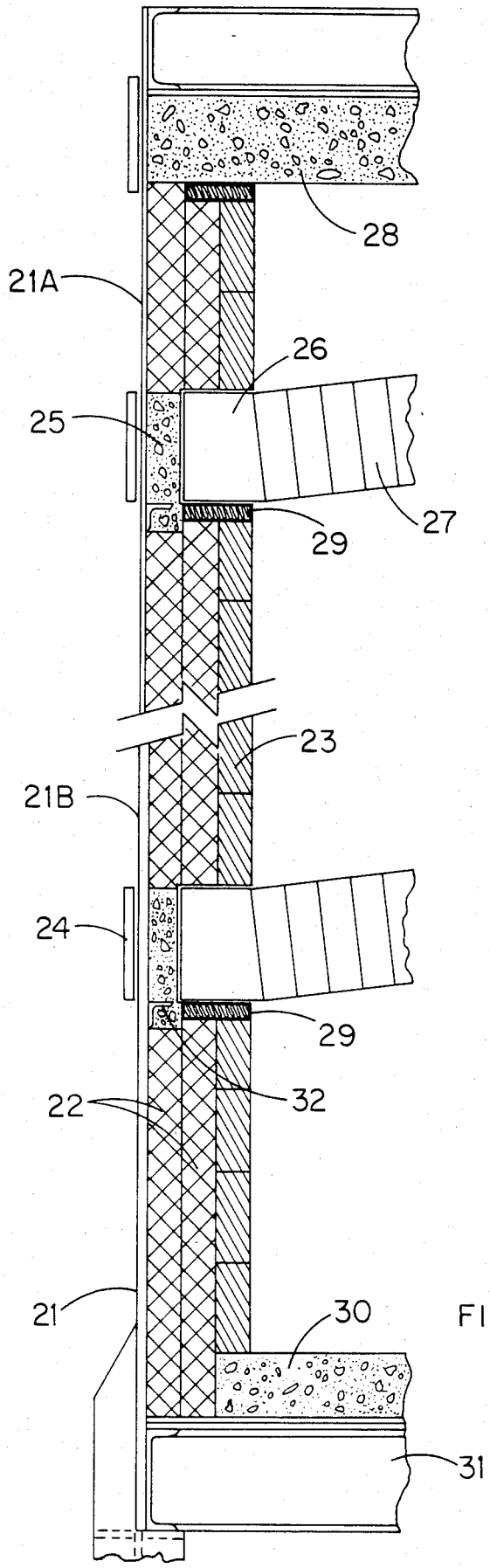
FIG. 4 is a cross-section view of a multiple hearth furnace chamber illustrating an embodiment of the instant invention.

FIG. 4 is a cross section of a multiple hearth furnace wall showing the features of the present invention. The wall comprises an outer metal shell 21, typically of steel, lined with one or more layers of thermal insulation 22. The internal wall comprises panels of firebrick 23 which rest on the skewback brick 26 immediately below. The lowest panel rests on the floor 30, which is underlain by floor support 31. Roof 28 encloses the furnace chamber. Buckstay bands 24 absorb the horizontal (radial) load exerted by the hearth 27 through the skewback bricks 26 and then through castable refractory rings 25.

Hearths 27 may be in the form of arched domes or conical frustums. For the purpose of this invention, the will be referred to as being "arched"; the center of each hearth is higher than its outer perimeter, ie. the hearth is upwardly directed.

The key feature is the design and location of expansion control joints 29 for expansion of the interior firebrick wall. Said control joints are located immediately below every skewback brick, as well as just below the roof 28. Such location ensures that each hearth will act as an independend structural unit, carrying only its own weight plus the weight of the wall bricks from the top of its skewback to the next higher control joint. The control joints provide a place for the interior brick wall panels to expand vertically in a fully predetermined manner, thus avoiding the moving of hearths, cracking or spalling of bricks, pivoting of skewbacks, loosening of hearth bricks, overstressing of buckstay bands, and other types of damage as was commonly experienced with prior art designs.

in order for the control joints to function properly, their design is as important as their location. Each joint is in the form of a continuous ring, rectangular in cross-section, with the internal diameter of the ring approximately equal in diameter to the interior diameter of the firebrick wall panels, and the width approximately equal to the thickness of the firebricks in the wall plus one layer of the insulating material behind the firebricks (between the steel exterior wall and the brick interior wall). The height of the joint is calculated based on: (1) The expected vertical expansion of the wall section from immediately below the joint, down to just above the next lower joint (or the furnace floor in the case of the lowest joint); and (2) The compressibility and re-expandability characteristics of the material chosen as the joint filler. Other factors to be considered in selection of the refractory joint filler material include its thermal stability and compressibility at furnace operating temperatures, and its cold compressive strength. A suitable filler material can be repeatedly compressed, without extruding, to 70 percent or less of its original thickness, and will re-expand when the load is removed, with no more than 5 percent permanent loss of its original thickness. It is more preferable to use a material which can be repeatedly compressed, without extruding, to 50 percent or less of its original thickness, and will re-expand when the load is removed, with no more than 2 percent permanent loss of its original thickness. Thermal stability should be greater than 90 percent at maximum design temperature. These qualities assure that a properly sized original joint, filled by the joint material, will remain tightly filled by the material throughout the life of the furnace, with no gap enlargement, in which ash particles may become packed, or joint material extrusions, which would be eroded away. The material selected must also have sufficient compressive strength in the cold condition to support the weight of the skewback bricks plus intermittent erection loads, ie, firebrick panel plus erection personnel and equipment, while the hearth is being constructed. It need not be capable of supporting a full hearth load, since upon completion, the arch geometry of a hearth transfers the load into mainly a horizontal thrust, as discussed previously. One material which has been found to meet the criteria for a joint filler material is a lightweight refractory fiber board, made predominantly of alumina ($Al_2O_3$) and silica ($SiO_2$) fibers, approximately 3 microns in diameter. The fibers are formed into a board of about 14 lb/cu.ft. density, which provides adequate resilience, rigidity, and heat resistance for the application. The included example of the structural design of a furnace illustrates the correct procedure for sizing the expansion joint.

The control joint 29 allow a preciseness in design which was not possible under prior art methods. This permits further changes in design compared to prior art, which result in economies of material, greater ease of installation or both.

Because the joint eliminates the possibility of unexpected loads being transferred into the shell at unexpected points, it is now possible to design the shell more precisely. The steel wall thickness calculation at any point can now be based on the theoretical accumulative loads due to the adjacent hearths and wall bricks. No longer must consideration be given to the possibility that loads from more distant hearths and walll bricks could be bypassing their design load transfer points due to hearths locking, friction joints slipping, skewback geometry distortion, or other results or uncontrolled expansion. This allows the use of thinner plate at higher levels, as shown in FIG. 4, where shell material 21B is thicker than material 21A.

Another benefit of the more precise design allowed by the control joints is the certainty that hearth and wall brick loads will be transferred to the buckstay bands and the steel exterior shell at predictable points, and will not be carried down to the furnace floor. This permits use of smaller structural supporting members under the horizontal furnace floor, since the shell loads are transferred directly to vertical columns which support the furnace over its foundations.

Figure 5:
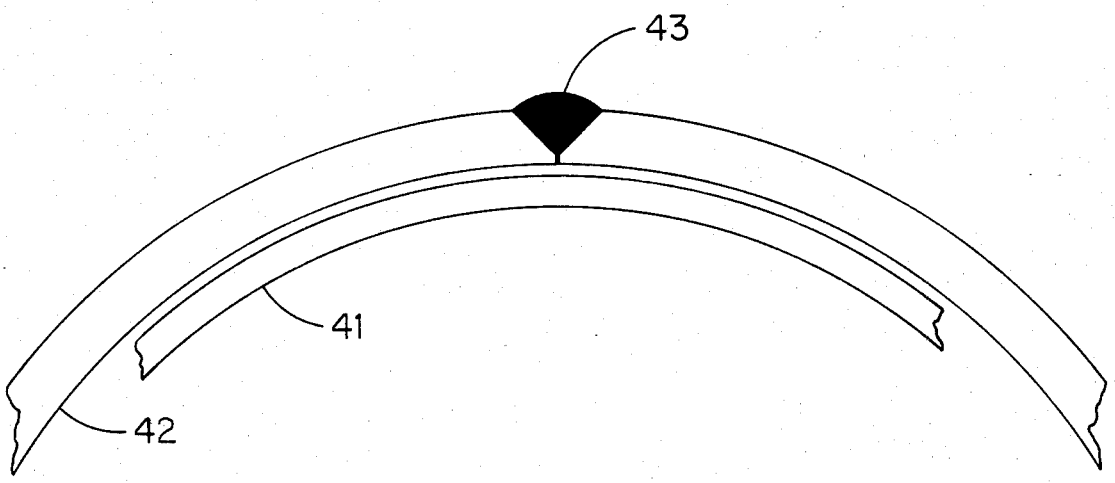
FIG. 5 illustrates a buckstay band according to this invention.

Further economies can be gained in buckstay band design and installation. Due to the better defined design loads, a band thickness can be selected to more closely match the calculated load, without the need for extra thickness to compensate for the possibility of additional loads from more distant hearths and walls. FIG. 5 illustrates further reduction in buckstay band material, resulting from providing the circumferential joint in the band 42 as a full penetration structural weld 43, rather than a bolted connection with a spice plate. Both holes in the band 42 girdling shell 41 reduce the cross sectional area available for tensile load transfer, which requires that the band be made wider or thicker, or both, to compensate. This additional material requirement is unnecessary when a welded joint 43 is used. Field installation problems are also reduced when a welded joint is used.

Figure 1:
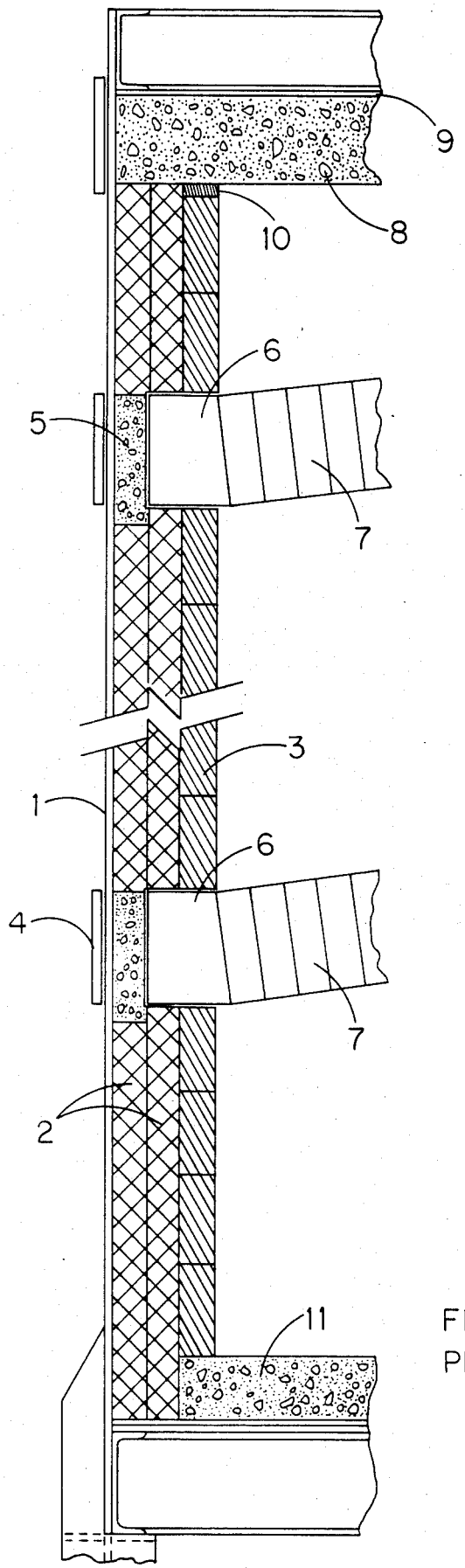
FIGURE 1 PRIOR ART
FIG. 1 is a sectional view of a prior art multiple hearth furnace chamber, in particular, the hearths and vertical wall.
Figure 2:
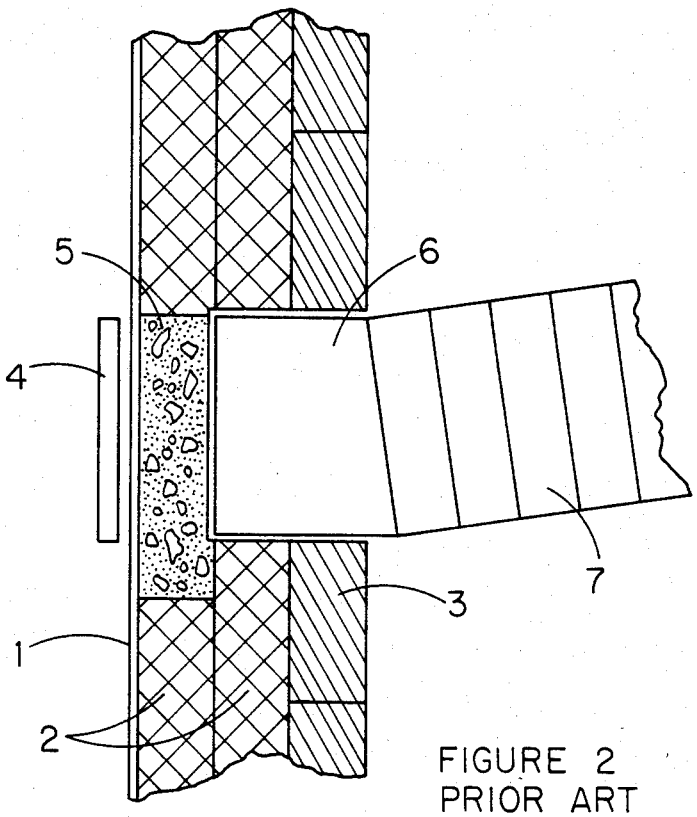
FIGURE 2 PRIOR ART
FIG. 2 is an enlargement of a portion of the prior art wall and hearth.
Figure 3:
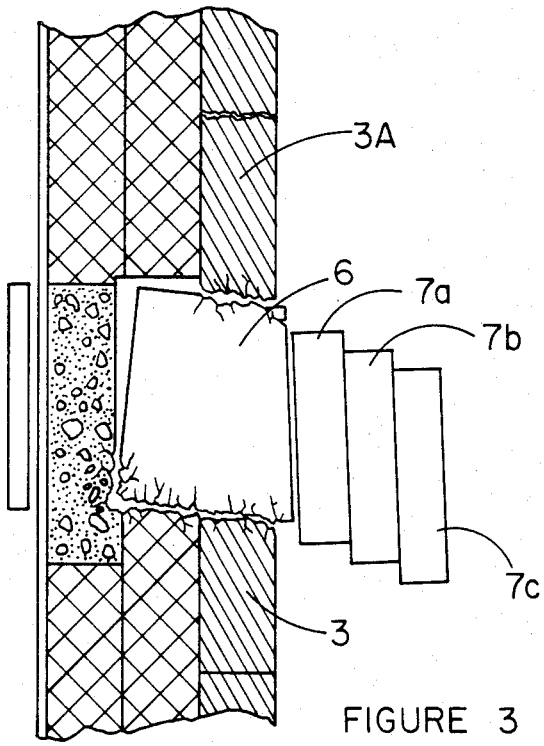
FIGURE 3 PRIOR ART
FIG. 3 shows a prior art furnace wall design, illustrating sources of furnace deterioration.

An additional provision can be made in the design to ensure that unwanted skewback movement is avoided. Referring to FIG. 2, as has previously been discussed, the prior art design depends on friction between the surfaces of the skewback 6 and the castable ring 5, and also between the surfaces of the castable ring 5 and the steel wall 1, to resist the downward vertical thrust component of the hearth load. It has been determined that the coefficient of friction between the skewback bricks 6 and the castable ring 5 is approximately two thirds higher than the coefficient of friction between the castable ring 5 and the exterior steel wall 1. This is due to the greater smoothness of steel as compared to brick and castable materials. It means that the capacity of the joint between the steel and castable materials to resist vertical thrust without material displacement is two thirds less than the capacity of the brick and castable joint. In certain instances, an application may require an unusually large furnace diameter, or exceptionally heavy hearth loads or both. In these cases, the expected resisting friction between the exterior wall 1 and the castable ring 5, while adequate to support expected loads, does not provide a sufficient safety factor to satisfy good engineering judgment and/or other specified requirements. Referring to FIG. 4, this is resolved in the present invention by adding an angle ring 32 at each hearth site, and extending the castable ring 25 to encapsulate it. The ring 32 is a standard structural angle shape, made of the same or similar steel as the exterior wall, with one leg vertically oriented and placed against the interior of the steel shell wall, and the other leg horizontally oriented and inwardly curved. The horizontal leg is located at approximately the same elevation as the bottom of the skewback brick. The vertical leg is preferably welded to the exterior wall 21 with discontinuous stitch welds. The horizontal leg is made with sufficient width so that the downward thrust component of the hearth load can be transferred to it from the adjacent horizontal surface of the castable ring, without causing local overstressing and consequent failure of the castable material. It is made thick enough so that its maximum deflection due to the expected vertical load (at the furthest point from the wall) will not exceed the elasticity of the castable material, thereby ensuring uniform load transfer from the castable material under all design conditions and avoiding the buildup of local overstressed points.

The following example of a multiple hearth furnace will more fully illustrate the improvements affected by the preferred embodiments of the present invention, compared to a design based on the prior art.

EXAMPLE

Figure 6:
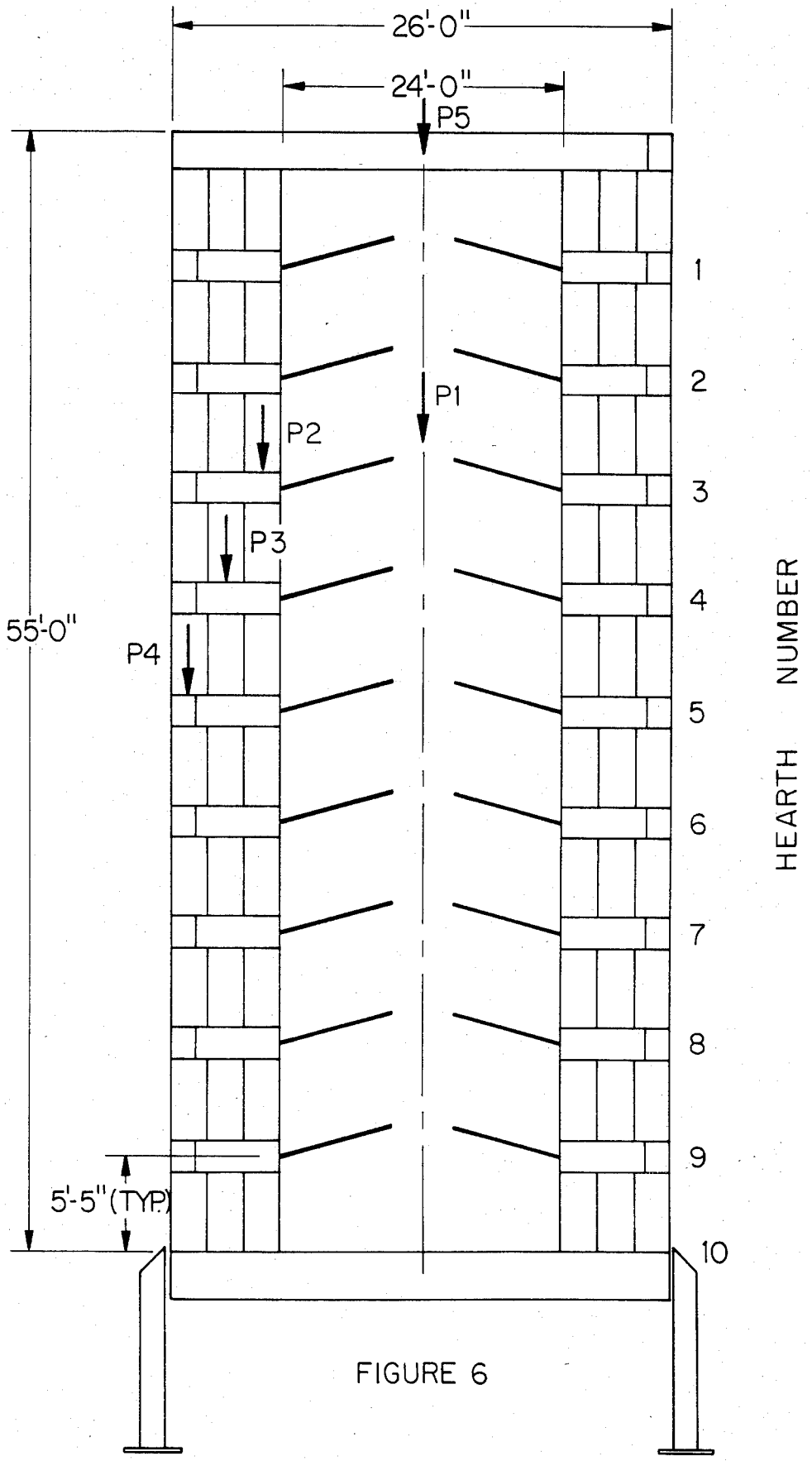
FIG. 6 is a drawing which shows the particular multiple hearth furnace of the Example.

An outline drawing of a typical multiple hearth furnace is shown in FIG. 6, and includes overall dimension, number of hearths (9 in this case, plus the floor and roof), and hearth spacing. For a furnace of this size the following component weights are typical:

| | |
|---|---|
| Total hearth weight $P_1$ | 40,000 lb. |
| Weight $P_2$ of firebrick wall panel between hearths | 18,000 lb. |
| Weight $P_3$ of inner layer of insulation between hearths | 1,500 lb. |
| Weight $P_4$ of outer layer of insulation between hearths | 2,800 lb. |
| Weight $P_5$ of roof | 50,000 lb. |

A typical operating temperature of such a furnace is 1800° F. with a range of about 1500°-2200° F. The skin temperature of the exterior steel shell is typically about 150° F. while the furnace is operating. For this example, a skin temperature of 150° F. results at the normal operating temperature of 1800° F.

Firebrick expands to about 100.3 percent of its original size at 1800° F. Steel expands at the rate of $6.5\times10^{-6}$ inches per inch per degree F. above 70° F.

1. Refractory Brick Stress Calculations—Prior Art Design

With prior art designs it is possible for tow hearths to become "locked" and fail to move vertically during a startup. For this example assume that hearths No. 2 and No. 7 are "locked".

The steel shell between these hearths will expand: 5 hearths$\times$5.5 ft/hearth$\times$12 inches/ft. $\times6.5\times10^{-6}$ in/in °F.$\times$(150°-70° F.)$\times$0.1716 inches vertical movement during startup.

The brick panel will also attempt to expand: 5 hearths$\times$5.5 ft/hearth$\times$12 inches/ft. $\times$0.003=0.99 inches vertical movement during startup.

Therefore the uncompensated expansion between the inner (brick) and outer (steel) walls will be:

$$\Delta=0.99-0.1716=0.8184 \text{ inches.}$$

This uncompensated expansion will produce pressure on the brickwork, which can be calculated as follows:

$$S=\frac{\Delta E}{l}$$

$\Delta$=The uncompensated expansion, which is 0.8184 in.

E=The Modulus of Elasticity of firebrick, which is $2.5\times10^6$ psi.

l=The length being compressed, which is $5\times5.5\times12=330$ inches.

$$S=\frac{(0.8184)(2.5\times10^6)}{330}=6200 \text{ psi}$$

Since the maximum compressive strength of firebrick is 2500 psi, brick will be crushed under this load.

2. Expansion Joint Design and Refractory Brick Stress Calculations, Applying the Present Invention Assume the same furnace dimensions, weights and operating conditions as in the prior art furnace, above. Vertical brick wall expansion per hearth is $$\frac{0.8184}{5}=0.16 \text{ inch.}$$

A joint filler material is selected which is compressible to 50 percent of its original thickness. Therefore the minimum joint thickness is $$.16\times\frac{1}{.5}=.32 \text{ inch.}$$

The pressure necessary to compress the joint filler material is 50 psi. Since this is less than the maximum compressive strength of the brick, 2500 psi, the brick will not crush.

The expansion joint material selected for this furnace is Johns-Manville® Cerafelt Joint Board, which meets the requirements of strength, compressibility and permanent deformation.

3. Shell Wall Thickness Calculations

A. Prior Art Design

These calculations will illustrate the advantages of the present invention with respect to the required wall thickness of the outer steel shell.

For example, in the prior art design, "locking in" of hearths No. 2 and 7 will have the following effect on the steel shell wall thickness required at the top of the ring of skewback bricks for hearth no. 2.

The upward (tensile) force due to restrained upward expansion of the brickwork, starting at hearth No. 7, equals the maximum pressure which will transfer through the brick, which is 2500 psi (a greater load will crush the brick), times the total load transfer area of the brick wall.

Assuming $4\frac{1}{2}''$ deep bricks, load transfer area$=(\pi/4)(24.75^2-24^2)=28.72$ ft$^2$ or 4135 in$^2$ Total upward force=2500 psi$\times$4135 in$^2$=10,337,500 lb.

The downward (compressive) force due to the weight of the roof, hearth No. 1, and the adjacent wall sections is:

Roof=50,000 lb.

Hearth=40,000 lb.

Walls=2(1800+2800+1500)=44,600 or Total=134,600 lb.

The net upward force=10,337,500−134,600=10,202,900 lb. If the steel shell has an allowable tensile strength of 20,000 psi, then the steel area required will be:

$$\frac{10,202,900}{20,000}=510 \text{ square inches.}$$

The plate thickness is calculated to be $$\frac{O.D. - I.D.}{2}$$

where O.D. is external diameter of the steel wall, being $26\times 12=312$ inches, and I.D. is the internal diameter of the steel wall.

Since $510=(\pi/4)(O.D.^2-I.D.^2)$ and I.D.=310.95 inches, the minimum required plate thickness is:

$$\frac{312 - 310.95}{2} = 0.525 \text{ inches.}$$

B. The Present Invention

The following calculations yield the steel wall thickness required at the top of the ring of skewback bricks for hearth no. 2, when the instant invention is utilized.

There will be no upward (tensile) force due to restrained upward expansion, except for the 50 psi required to compress the joint filler material in the expansion joint below the skewback for hearth No. 2, which can be neglected.

The downward (compressive) force due to the weight of the roof, hearth No. 1 and the adjacent wall sections if the same as in part 3A of this example, or 134,600 lb.

The steel shell has an allowable compressive strength of 1450 psi, assuming a $\frac{1}{8}''$ wall thickness.

Actual compressive load on a $\frac{1}{8}''$ steel plate wall:

Area$=(\pi/4)(312^2-311.75^2)=122.47$ in$^2$ of steel.

$$\text{Stress} = \frac{134,600}{122.47} = 1099 \text{ psi}$$

which is less than 1450.

Therefore for stress purposes a thinner wall plate could be used; however for rigidity during erection no less than a $\frac{1}{8}''$ thick plate would be used.

4. Buckstay Band and Angle Ring Calculations

A. According to the Present Invention

With expansion joints to prevent the accumulation of hearth loads and uncompensated expansion stresses, each buckstay is designed to resist only:

(1) Hearth arch forces (2) Refractory radial thermal expansion forces.

Both are dependent upon the geometry of the hearth and the characteristics of the materials selected. Typical values for a furnace of the dimensions in this example are:

(1) 60,000 lb hearth and arch forces.

(2) 30,000 lb refractory radial thermal expansion forces.

Total=90,000 lb, which is resisted by tensile force in the buckstay band.

A buckstay band 8 inches wide by $\frac{3}{4}$ inch thick, having 7 in$^2$ cross-sectional area, will have a tensile stress of 90,000 lb÷7 in$^2$=12,857 psi.

According to good engineering practice, buckstay bands are designed for a maximum stress of 15,000 psi to allow for erection stresses and other design uncertainties. Therefore, this buckstay band size meets all of the requirements, provided the cross-sectional area is not reduced at any location along the band, for instance, where the band ends are joined by a bolted plate. A full penetration weld at the joint will maintain the required cross-section area.

Figure 7:
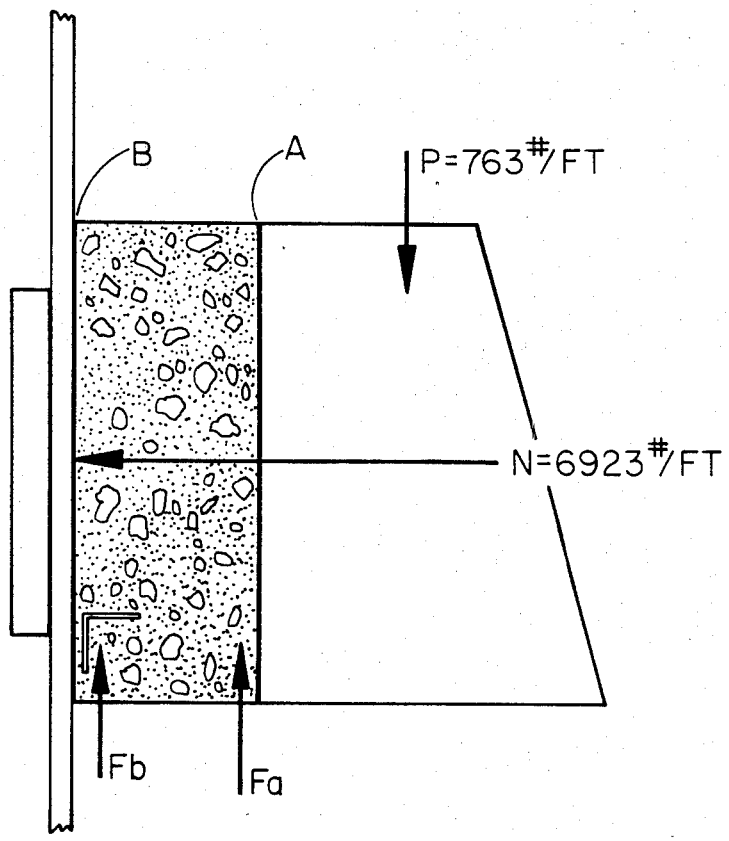
FIG. 7 is an expanded view of a skewback brick of the Example, indicating the forces working thereon.

Assuming a buckstay tensile force of 90,000 lbs the horizontal radial force delivered to the buckstay is $$\frac{2(90000)}{26} = 6923 \text{ lb/ft,}$$

as shown on FIG. 7 as N.

The weight supported by each skewback is:

hearth=40,000 lb wall brick=18,000 lb insulation (2 layers)=1500 lb and 2,800 lb Total=62,300 lb.

The weight per foot of circumference at the joint between the castable ring and the steel wall, shown as P on FIG. 7 is:

$$\frac{62,300}{\pi(26)} = 763 \text{ lb/ft}$$

The friction factor, $\mu$ for castable against steel is 0.30. Therefore, the frictional resistance $F_b$ of the joint at surface B is:

$$F_b=\mu N=0.3\times 6923=2077 \text{ lb}$$

A prudent safety factor for this joint is 3.

3P=3×763 lb=2289 lb which is greater than the calculated resisting force of 2077 lb. Therefore an angle ring is needed to support the castable ring.

This is compared to the joint A between the castable and the skewback:

$\mu$ for these materials is 0.5, and $$P = \frac{62,300}{\pi(25.33)} = 783 \text{ lb/ft of circumference;}$$

therefore, $F_a=\mu N=0.5\times 6923=3461$ lb.

The safety factor of 3 yields a design force of 3P=3×783 lb/ft=2349 lb/ft, which is less than 3461; therefore no additional strength is needed to maintain the castable ring and skewback bricks relative to each other.

B. According to the Prior Art

The load transmitted to the skewback frm the firebrick can be anything up to the crushing stress of the bricks, 2500 psi. In the worst case, $$P=4\tfrac{1}{2}''\times 12''\times 2500=135,000 \text{ lb/ft of circumference.}$$

If the hearth is "locked in" and does not slip, the skewback bricks will rotate, flattening the arch. This will create radial forces in the order of magnitude of:

$$F=135,000=0.5N.$$

N=270,000 lb, which translates into a tensile force in the buckstay band of $$T = \frac{270,000(26)}{2} = 3,510,000 \text{ lb.}$$

Selecting an allowable tensile stress of 15,000 psi in the buckstay, its cross sectional thickness must be $$\frac{3,510,000}{1500} = 234 \text{ in}^2$$

which requires a band $24''\times 9\frac{3}{4}''$. Such a size is beyond the limits of reasonabity. The calculation, coupled with field experience, demonstrates that what actually happens is that a combination of buckstay stretching, skewback slippage and wall brick distortion occurs to relieve the theoretical load.

From this example, it is clear that the present invention results in a furnace having much reduced destructive effects of thermal expansion.

We claim:

1. A multiple hearth furnace chamber, comprising:

a cylindrical metal shell, having its axis oriented vertically, having one or more buckstay bands horizontally encircling its exterior to absorb outward-directed radial forces, and having refractory roof and floor;

a plurality of upwardly-directed, refractory, temperature-expansible hearths spaced vertically within said shell, having openings for passage of combustibles, gases and ash therethrough, each hearth having its outer perimeter in the same horizontal plane as one of said buckstay bands;

spaces within said chamber between said hearths comprising hearth spaces;

plural rings of high strength castable refractory, each encircling the inside of said shell in the same horizontal plane as one of said buckstay bands;

a single row of skewback bricks encircling said perimeter of each of said hearths and abutting said refractory rings of high strength castable refractory, to direct forces generated by the weight and radial thermal expansion of said hearths through said refractory rings and said shell to said buckstay bands such that friction between said shell and said refractory rings and between said refractory rings and said skewback bricks support each hearth independently in a substantially unchanging horizontal plane;

furnace lining comprising panels of firebricks encircling and spaced from said inside of shell between adjacent hearths, resting on and supported by the skewback bricks immediately below each of said panels and separated from the skewback bricks immediately above each of said panels by an expansion joint;

said expansion joint comprising an insulating, compressible, refractory material to absorb vertical displacement of said panels of firebricks resulting from thermal expansion, without generating high stress on skewback bricks above each of said panels; and thermal insulation filling said space between said firebrick panel lining and said metal shell.

2. A multiple hearth furnace chamber according to claim 1, wherein said expansion joint comprises a material which, at normal furnace operating temperatures, will withstand, without significant extrusion, repeated compression to 70 percent or less of its original thickness with no more than 5 percent permanent loss of original thickness when stress is removed.

3. A multiple hearth furnace chamber according to claim 1, wherein said expansion joint comprises a material which, at normal furnace operating temperatures, will withstand, without significant extrusion, repeated compression to 50 percent or less of its original thickness with no more than 2 percent permanent loss of original thickness when stress is removed.

4. A multiple hearth furnace chamber according to claim 1, wherein said expansion joint supports said row of skewback bricks and panel of firebricks immediately thereabove, together with construction personnel and equipment thereon, while the furnace is being constructed.

5. A multiple hearth furnace chamber according to claim 1, wherein said expansion joint material is a fiberboard comprised predominantly of alumina and silica fibers.

6. A multiple hearth furnace chamber according to claim 1, wherein the thickness of said cylindrical metal shell is decreased stepwise from the bottom to the top in accordance with the vertical structural load at each level of said shell.

7. A multiple hearth chamber according to claim 1, further comprising angle rings, attached to said metal shell and encapsulated in said rings of castable refractory, to support said rings of castable refractory in a stationary position relative to said metal shell.

8. A multiple hearth furnace chamber according to claim 1, wherein one or more of said buckstay bands comprises a strip of metal bar or plate having its ends joined by a full penetration structural weld to form a continuous band girdling said metal shell.

* * * * *